US005102048A

United States Patent [19]

Bohnhoff

[11] Patent Number: 5,102,048

[45] Date of Patent: Apr. 7, 1992

[54] IRRIGATION HEAD SUPPORT

[76] Inventor: William W. Bohnhoff, 12501 E. Amherst Cir., Aurora, Colo. 80014

[21] Appl. No.: 575,630

[22] Filed: Aug. 31, 1990

[51] Int. Cl.[5] ..... B05B 15/06

[52] U.S. Cl. ..... 239/201; 239/288.3; 239/288.5

[58] Field of Search ..... 239/200, 201, 273, 288, 239/288.3, 288.5

[56] References Cited

U.S. PATENT DOCUMENTS

| | | | |
|---|---|---|---|
| D. 256,386 | 8/1980 | Bergland | 239/201 X |
| 70,076 | 10/1864 | Dean . | |
| 685,230 | 10/1901 | Speirs | 239/288.5 |
| 1,071,091 | 8/1913 | Rogers . | |
| 1,905,176 | 4/1933 | Kieckhefer . | |
| 2,315,180 | 3/1943 | Arthur . | |
| 2,315,448 | 3/1943 | Hagin et al. . | |
| 2,369,412 | 2/1945 | Ruppel . | |
| 2,751,250 | 6/1956 | Block | 239/288.3 X |
| 2,876,628 | 3/1959 | Dixon, Jr. . | |
| 2,899,775 | 8/1959 | Partin . | |
| 2,912,910 | 11/1959 | Wilson et al. . | |
| 3,015,448 | 1/1962 | Hurless | 239/288.5 X |
| 3,018,057 | 1/1962 | Anderson | 239/201 |
| 3,361,364 | 1/1968 | Purtell | 239/288.5 |
| 3,514,040 | 5/1970 | Carson | 239/288.5 |
| 3,597,928 | 8/1971 | Pilaar . | |
| 3,650,478 | 3/1972 | Jones | 239/201 X |
| 3,762,642 | 10/1973 | Di Santo | 239/288.5 X |
| 3,903,702 | 9/1975 | Appleton . | |
| 3,904,120 | 9/1975 | Sbicca | 239/288.5 X |
| 3,990,247 | 11/1976 | Palmer . | |
| 4,067,197 | 1/1978 | Ritter . | |
| 4,111,585 | 9/1978 | Mascaro . | |
| 4,146,181 | 3/1979 | Soos | 239/288.5 |
| 4,329,392 | 5/1982 | Bronner . | |
| 4,582,256 | 4/1986 | Jaquez | 239/288.5 |
| 4,610,568 | 9/1986 | Koerner . | |
| 4,621,942 | 11/1986 | Hill . | |
| 5,037,030 | 8/1991 | Apodaca | 239/288 |

FOREIGN PATENT DOCUMENTS

| | | |
|---|---|---|
| 676764 | 12/1947 | Belgium . |
| 1928014 | 12/1970 | Fed. Rep. of Germany . |
| 2410331 | 9/1974 | Fed. Rep. of Germany . |
| 2818793 | 11/1979 | Fed. Rep. of Germany . |
| 45684 | 11/1980 | Japan . |

*Primary Examiner*—Andres Kashnikow
*Assistant Examiner*—William Grant

[57] ABSTRACT

An irrigation head support includes a circular mat formed by a plurality of concentric circular ribs connected by a plurality of circumferentially spaced radially extending ribs. Interstitial spaces formed between the intersecting ribs allow passage of plant roots through the mat to stabilize the mat in a selected position, just buried beneath the ground surface. A central circular aperture in the mat is dimensioned for reception of an irrigation head. A plurality of arcuate upstanding struts are spaced circumferentially about the periphery of the circular mat and have a vertical extent above the mat equal to the vertical extent of the support ribs above the mat. In use, the mat is placed around an irrigation head and covered with a filler material such as earth or sod. Grass roots subsequently grow through the interstitial spaces in the mat to secure the mat permanently in place. The irrigation head support prevents damage to the irrigation head from vehicle tires and also prevents erosion of the soil surrounding the irrigation head.

57 Claims, 3 Drawing Sheets

IRRIGATION HEAD SUPPORT

BACKGROUND OF THE INVENTION

The present invention relates to irrigation head supports, and more particularly pertains to an improved irrigation head support for use with irrigation heads at least partially buried in earth. Irrigation heads including fixed and pop-up type sprinkler heads are employed on golf courses and in a variety of other landscaping environments. Such irrigation heads are exposed to and are frequently damaged by vehicle tires such as those found on lawn tractors and golf carts. Additionally, the soil surrounding the irrigation heads is quickly saturated during operation of the head, causing soil erosion and subsequent undermining of the irrigation head.

SUMMARY OF THE INVENTION

The present invention is directed to an improved irrigation head support which includes a circular mat formed by a plurality of concentric circular ribs connected by a plurality of circumferentially spaced, radially extending ribs. Interstitial spaces formed between the intersecting ribs allow passage of plant roots through the mat to stabilize the mat in a selected position, buried just beneath the ground surface. A central circular aperture in the mat is dimensioned for reception of an irrigation head. A plurality of arcuate upstanding struts are spaced circumferentially around the central aperture for abutment with a radially extending support flange on the irrigation head. A plurality of upstanding tubular rings are spaced circumferentially about the periphery of the circular mat and have a vertical extent above the mat equal to the vertical extent of the support ribs above the mat. In use, the mat is placed around an irrigation head and covered with a fill material such as earth or sod. Grass roots subsequently grow through the interstitial spaces in the mat to secure the mat permanently in place. The irrigation head support prevents damage to the irrigation head from vehicle tires and also prevents erosion of the soil surrounding the irrigation head.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
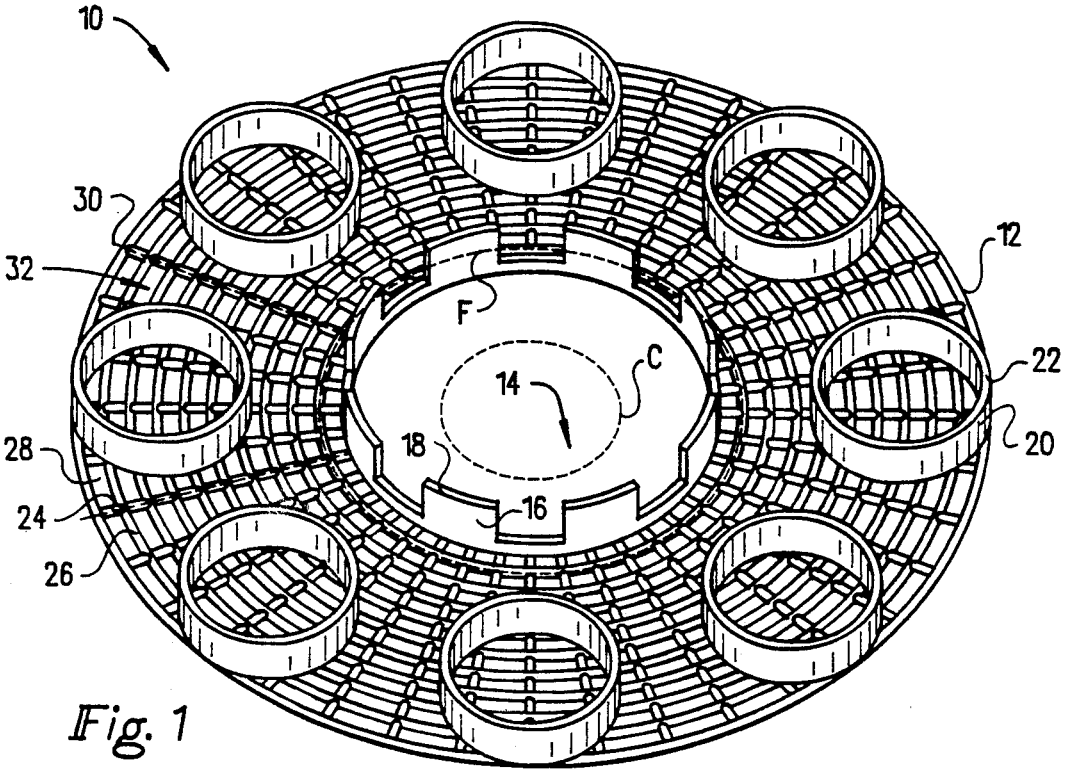
FIG. 1 is a perspective view of the irrigation head support according to the present invention.

Referring now to the drawings, wherein like reference numerals designate corresponding structure throughout the views, and referring in particular to FIG. 1, an improved irrigation head support 10 according to a first preferred embodiment of the invention includes a perforate mat 12, which is preferably circular, but may be formed in a variety of other shapes without departing from the scope of the present invention. A central circular aperture 14 is formed through the mat 12 and is dimensioned to receive a conventional irrigation head. The aperture 14 may be formed in different sizes to accommodate different standard sizes of irrigation heads. For example, a first standard size irrigation head requires a five and one-half inch diameter aperture and a second standard size irrigation head requires a seven and one-half inch aperture. Another conventional irrigation head has a diameter of only two to two and one-half inches, and thus requires a correspondingly smaller central aperture 14.

Figure 3:
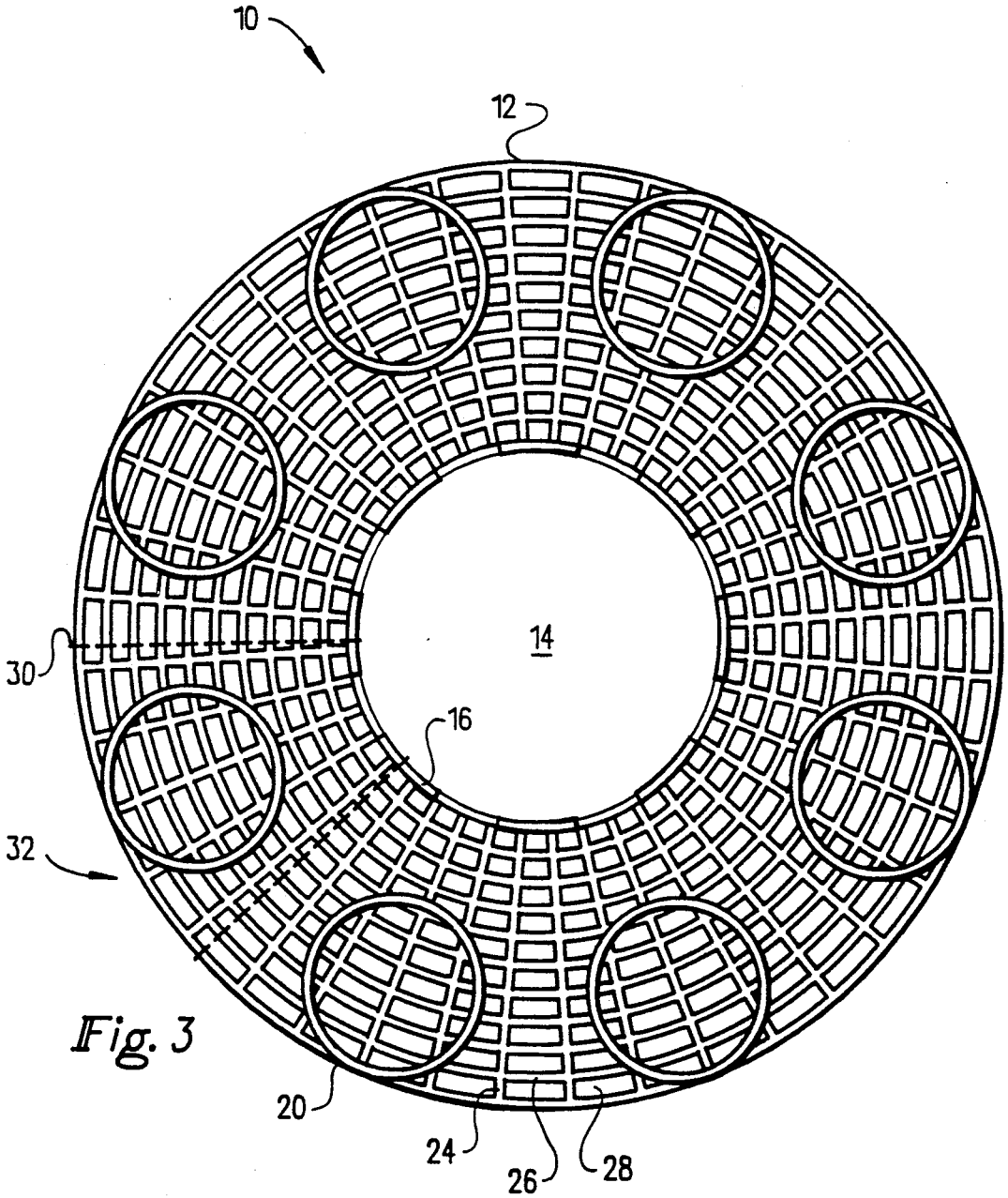
FIG. 3 is a top plan view illustrating the irrigation head support.

A plurality of upstanding support struts 16 are spaced circumferentially about the aperture 14, as depicted in FIG. 3. The struts 16 are preferably arcuate, forming a vertical section of a sidewall portion of a cylinder. The struts 16 have an upper surface 18 disposed in a common horizontal plane and adapted for abutment with the bottom surface of a radially extending flange F, shown in phantom line in FIG. 1, provided on conventional irrigation heads. The circumferential spaces between the struts 16 are adapted to receive vertically downwardly extending projections (not shown) formed on the under-side of the flange F on some conventional irrigation heads. The irrigation head may be of the type having a vertically reciprocal cover C, shown in phantom line, which "pops-up" during sprinkler operation. The flange F is stationary, and serves to support the irrigation head within the aperture 14. The struts 16 may be omitted, for use of the mat 12 with irrigation heads of the type lacking the radial flange F.

Figure 6:
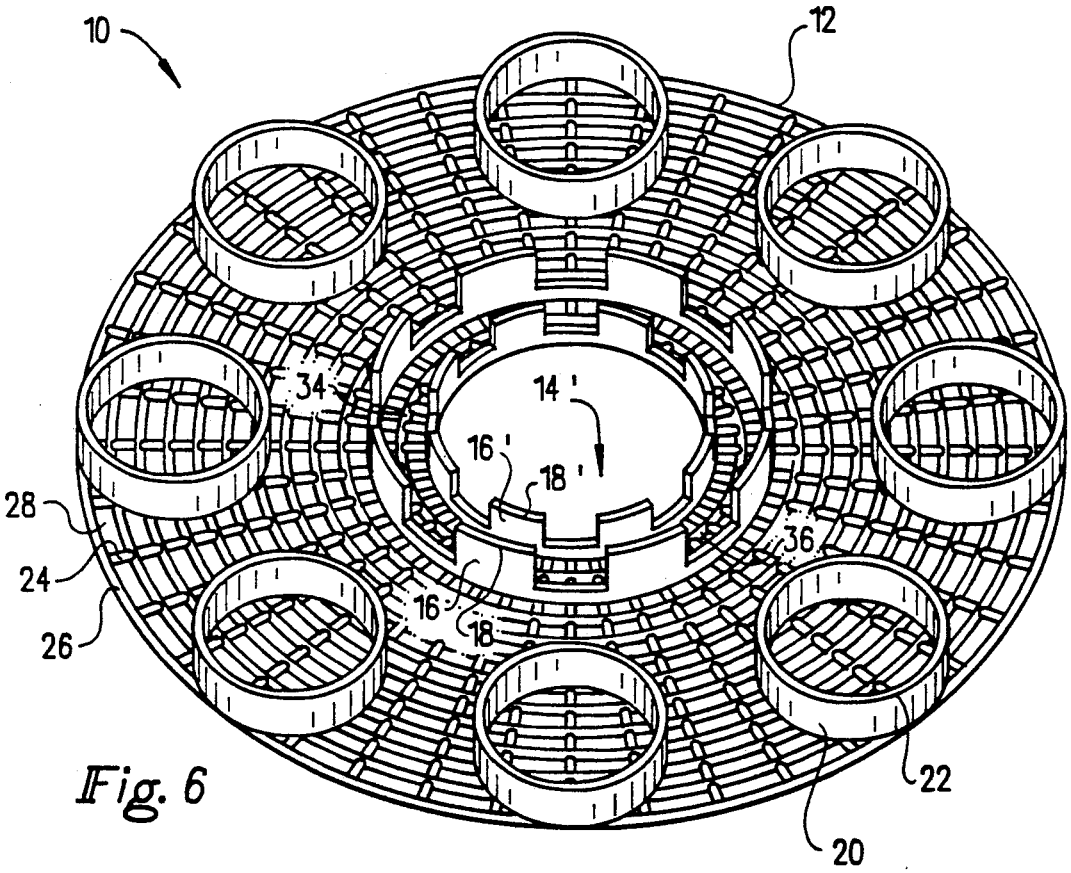
FIG. 6 is a perspective view illustrating an irrigation head support according to a second embodiment of the invention.

FIG. 6 illustrates a second embodiment of the irrigation head support 10', in which two concentric rings provide a larger diameter support ring of support struts 16 and a smaller diameter support ring of support struts 16'. In the illustrated condition, the irrigation head support 10' is adapted for use with irrigation heads having a first, smaller diameter body and radial flange. The central aperture 14' is of a correspondingly reduced diameter. In order to adapt the irrigation head support 10' for use with a second, larger diameter standard size irrigation head, the radially extending ribs 24 which connect the inner struts 16' are severed along lines 34. This will result in a larger diameter central aperture and leave support struts 16' intact, to support the radial irrigation head flange. An intermediate circular rib 36 may be provided to further support the inner struts 16'. The rib 36 will of course be cut away, along with the inner struts 16', when the radial ribs 24 are severed along lines 34. It is also contemplated that the selected configuration of the struts 16 and 16' may be achieved by replacing a central section of a production mold.

Figure 2:
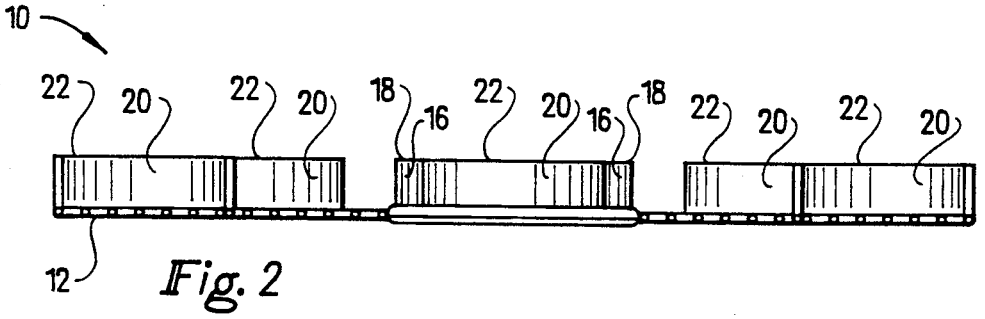
FIG. 2 is a representative side elevational view illustrating the irrigation head support.

As best seen in FIGS. 1 and 3, a plurality of upstanding tubular members take the preferred form of cylindrical rings 20, which are spaced uniformly circumferentially adjacent the periphery of the mat 12. As illustrated in FIG. 2, the rings 20 each have an upper annular surface 22 disposed in a horizontal plane at a vertical extend above the mat 12 equal to a vertical extent of the top surface portion 18 of the struts 16. It should be noted that other tubular forms, for example those having hexagonal, square, triangular, rectangular, etc., transverse cross-sectional shapes may be substituted for the cylindrical ring form within the scope of the invention.

Figure 4:
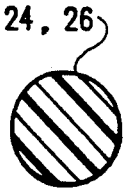
FIG. 4 is a transverse cross-sectional view illustrating a first alternative rib construction of the mat portion of the irrigation head support.
Figure 5:
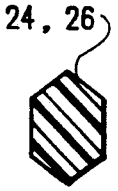
FIG. 5 is a transverse cross-sectional view illustrating a second alternative rib construction of the mat portion of the irrigation head support.

The mat 12 has a perforate construction, and is formed by a plurality of concentric circular ribs 26 connected by a plurality of circumferentially spaced radially extending ribs 24. Interstitial spaces 28 are formed by the intersecting ribs 24 and 26. FIG. 4 illustrates a first alternative transverse cross-sectional circular shape of the ribs 24 and 26. In this construction, the ribs have the shape of a cylindrical rod. As shown in FIG. 5, the ribs 24 and 26 may alternatively be formed with a hexagonal transverse cross-sectional shape. Additionally, it should be understood that while circular and hexagonal constructions have been illustrated, a variety of different geometric shapes of ribs may be employed, within the scope of the present invention.

The intersecting rib construction of the mat 12 is important in several aspects. This construction provides a support surface which is rigid in both vertical and horizontal directions, such that upstanding tubular rings 20 provide a vertical support surface for vehicle tires and other loads, and also prevent lateral displacement and compaction of soil. It is an important feature of the invention that the mat 12 be formed from a rigid material such as a thermoplastic, in order to prevent relative displacement of the rings 20 in lateral and vertical direction during loading. The entire head support 10 is preferably integrally injection molded from a high-impact polymer thermoplastic material having resistance to ultraviolet radiation. Alternatively, the rings 20 and support struts 16 may be formed separately and adhesively or otherwise secured to the mat 12. Thus, the mat 12 provides a rigid connection between the rings 20, which prevents vertical and lateral displacement of the individual rings relative to the position of the supported irrigation head.

Additionally, it is important that the mat have a perforate structure for the reception of plant roots to secure the mat in an installed location, preventing soil erosion, infiltration of soil into the irrigation head, and maintaining support strength when the soil is saturated.

As illustrated in FIGS. 1 and 3, weakened, reduced diameter zones 30 are provided on some of the ribs 24 and 26 to form an easily removable section 32, shown in phantom line, which communicates with the central aperture 14. The removable section 32 may be detached by breaking the ribs 24 and 26 at the weakened zones 30 to accommodate hydraulic valves provided on some conventional types of irrigation heads. The removable section 32 thus forms a clearance space to allow insertion of the mat 12 over the irrigation head and attached valve.

To install the irrigation head support 10 of the present invention, the irrigation head is inserted at least partially through the aperture 14, with the flange F disposed in abutment with the top surface portion 18 of the strut 16. It should be noted that the irrigation head support 10 may be installed without detaching an existing irrigation head from a water supply pipe.

After the mat 12 is disposed around the irrigation head, the mat 12 is covered with a fill material such as earth or sod, to a level even with top surfaces 22 of the rings 20. The rings 20 are also filled to enhance the stabilization of the soil around the irrigation head. The earth may be then planted with grass, whereupon subsequent growth of the grass roots through the interstitial mat spaces 28 will further stabilize the mat 12 in the installed location, preventing subsequent soil erosion. As the perforated mat 12 extends beneath and forms the floor of each of the rings 20, it can be appreciated that plant roots may also grow through the rings 20. The support 10 may also be installed during new construction of irrigation systems, and eliminates the need to position irrigation heads above the finished grade.

It should be understood that the mat 12, support struts 16 and rings 20 may be formed with a variety of different dimensions, to accommodate various environmental situations and different sizes of irrigation heads. An example construction of the irrigation head support 10 utilizes a mat 12 having a diameter of eighteen inches, rings 20 having a vertical extent of three-fourths to one inch and a diameter of three inches. The rings 20 may have a wall thickness of 0.1 inches and may be slightly frustoconically tapered to provide mold release clearance during an injection molding manufacturing process. The support struts 16 preferably have a vertical extent of three-fourths to one inches, equal to that of the rings 20. The ribs 24 and 26 preferably have a diameter of one-eighth to one-fourth of an inch. It should be understood that the thickness of the various components of the irrigation head support 10 depends on the strength of the thermoplastic material utilized in the injection molding process. As such, there are performance and economic tradeoffs between the greater costs of the higher strength plastic material and the greater amount of material required with a lower strength, but less expensive plastic.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An irrigation head support, comprising:

a substantially rigid mat having a plurality of spaced perforations dimensioned to allow passage of plant root therethrough;

an aperture in said mat for receiving an irrigation head therethrough;

support means for supporting an irrigation head within said aperture; and at least one upstanding tubular member on said mat.

2. The irrigation head support of claim 1, wherein said support means comprises at least one upstanding strut on said mat adjacent said aperture.

3. The irrigation head support of claim 2, wherein a plurality of upstanding struts are spaced around said aperture.

4. The irrigation head support of claim 2, wherein said at least one strut has a vertical extent above said mat substantially equal to a vertical extent of said at least one tubular member above said mat.

5. The irrigation head support of claim 3, wherein said struts each have a vertical extent above said mat substantially equal to a vertical extent of said at least one tubular member above said mat.

6. The irrigation head support of claim 1, wherein said mat is formed by a plurality of intersecting ribs forming interstitial spaces.

7. The irrigation head support of claim 6, wherein said ribs have a substantially circular transverse cross-sectional shape.

8. The irrigation head support of claim 6, wherein said ribs have a substantially hexagonal transverse. cross-sectional shape.

9. The irrigation head support of claim 1, wherein said mat is substantially circular.

10. The irrigation head support of claim 9, wherein said aperture is formed substantially centrally through said mat.

11. The irrigation head support of claim 9, wherein said mat is formed by a plurality of intersecting substantially circularly extending ribs and substantially radially extending ribs.

12. The irrigation head support of claim 9, wherein said mat is formed by a plurality of concentric substantially circular ribs connected by a plurality of circumferentially spaced substantially radially extending ribs.

13. The irrigation head support of claim 12, wherein said ribs have a substantially circular transverse cross-sectional shape.

14. The irrigation head support of claim 12, wherein said ribs have a substantially hexagonal transverse cross-sectional shape.

15. The irrigation head support of claim 1, wherein a plurality of upstanding tubular members are spaced about said mat.

16. The irrigation head support of claim 1, wherein said at least one tubular member comprises a substantially circular ring.

17. An irrigation head support, comprising:

a substantially rigid mat formed by a plurality of spaced intersecting ribs, spaces between said ribs defining a plurality of perforations dimensioned to allow passage of plant roots therethrough;

an aperture in said mat for receiving an irrigation head therethrough;

support means for supporting an irrigation head within said aperture; and at least one upstanding tubular member on said mat.

18. The irrigation head support of claim 17, wherein a plurality of upstanding tubular members are spaced about said mat.

19. The irrigation head support of claim 18, wherein said tubular members comprise substantially circular rings.

20. The irrigation head support of claim 17, wherein said support means comprises at least one upstanding strut on said mat adjacent said aperture.

21. The irrigation head support of claim 20, wherein a plurality of upstanding struts are spaced around said aperture.

22. The irrigation head support of claim 21, wherein said struts have a vertical extent above said mat substantially equal to a vertical extent of said at least one tubular member above said mat.

23. The irrigation head support of claim 17, wherein said mat is formed by a plurality of intersecting substantially circular ribs and radial ribs.

24. The irrigation head support of claim 17, wherein said mat is formed by a plurality of concentric substantially circular ribs connected by a plurality of circumferentially spaced substantially radially extending ribs.

25. The irrigation head support of claim 17 further comprising pre-formed weakened zones on said ribs to allow removal of a section of said mat adjacent said aperture.

26. An irrigation head support for use with an irrigation head having a radially extending flange, comprising:

a substantially rigid mat having a plurality of spaced perforations dimensioned to allow passage of plant roots therethrough;

an aperture in said mat dimensioned to receive an irrigation head therethrough;

support means dimensioned for engagement with the radially extending flange of the irrigation head for supporting the irrigation head at least partially above said mat; and at least one upstanding tubular member on said mat.

27. The irrigation head support of claim 26, wherein a plurality of upstanding tubular members are spaced about said mat.

28. The irrigation head support of claim 27, wherein said tubular members comprise substantially circular rings.

29. The irrigation head support of claim 26, wherein said support means comprises at least one upstanding strut on said mat adjacent said aperture.

30. The irrigation head support of claim 29, wherein a plurality of upstanding struts are spaced around said aperture.

31. The irrigation head support of claim 30, wherein said struts have a vertical extent above said mat substantially equal to a vertical extent of said tubular member above said mat.

32. The irrigation head support of claim 26, wherein said mat is formed by a plurality of intersecting circular ribs and radial ribs.

33. The irrigation head support of claim 26, wherein said mat is formed by a plurality of concentric substantially circular ribs connected by a plurality of circumferentially spaced substantially radially extending ribs.

34. The irrigation head support of claim 33, further comprising pre-formed weakened zones on said ribs to allow removal of a section of said mat adjacent said aperture.

35. An irrigation head support for use with an irrigation head having a radially extending flange, comprising:

a substantially rigid perforate mat formed by a plurality of concentric substantially circular ribs connected by a plurality of circumferentially spaced substantially radially extending ribs;

an aperture formed centrally in said mat and dimensioned to receive an irrigation head therethrough;

a plurality of upstanding struts on said mat, said struts spaced circumferentially about said aperture; and a plurality of upstanding tubular members spaced about said mat and having a vertical extent above said mat substantially equal to a vertical extent of said struts above said mat.

36. An irrigation head support, comprising:

a substantially rigid mat;

an aperture in said mat for receiving an irrigation head therethrough;

support means for supporting an irrigation head within said aperture, said support means including at least one selectively removable portion for converting said irrigation head support for use with at least two different standard sized irrigation heads; and at least one upstanding tubular member on said mat.

37. The irrigation head support of claim 36, wherein said support means comprises at least one upstanding strut on said mat adjacent said aperture.

38. The irrigation head support of claim 37, wherein a plurality of upstanding struts are spaced around said aperture.

39. The irrigation head support of claim 37, wherein said at least one strut has a vertical extent above said mat substantially equal to a vertical extent of said at least one tubular member above said mat.

40. The irrigation head support of claim 38, wherein said struts each have a vertical extent above said mat substantially equal to a vertical extent of said at least one tubular member above said mat.

41. The irrigation head support of claim 36, wherein said mat is formed by a plurality of intersecting ribs forming interstitial spaces.

42. The irrigation head support of claim 41, wherein said ribs have a substantially circular transverse cross-sectional shape.

43. The irrigation head support of claim 41, wherein said ribs have a substantially hexagonal transverse cross-sectional shape.

44. The irrigation head support of claim 36, wherein said mat is substantially circular.

45. The irrigation head support of claim 44, wherein said aperture is formed substantially centrally through said mat.

46. The irrigation head support of claim 44, wherein said mat is formed by a plurality of intersecting substantially circularly extending ribs and substantially radially extending ribs.

47. The irrigation head support of claim 44, wherein said mat is formed by a plurality of concentric substantially circular ribs connected by a plurality of circumferentially spaced substantially radially extending ribs.

48. The irrigation head support of claim 47, wherein said ribs have a substantially circular transverse cross-sectional shape.

49. The irrigation head support of claim 47, wherein said ribs have a substantially hexagonal transverse cross-sectional shape.

50. The irrigation head support of claim 36, wherein a plurality of upstanding tubular members are spaced about said mat.

51. The irrigation head support of claim 36, wherein said at least one tubular member comprises a substantially circular ring.

52. An irrigation head support for use with an irrigation head having a radially extending flange, comprising:

a substantially rigid perforate circular mat formed by a plurality of radially spaced concentric substantially circular ribs connected by a plurality of circumferentially spaced substantially radially extending ribs;

a substantially circular aperture formed centrally in said mat and dimensioned to receive an irrigation head therethrough;

pre-formed weakened zones on some of said ribs disposed to allow selective removal of a pie-shaped section of said mat adjacent said aperture to form a clearance space;

a plurality of substantially perpendicularly upstanding struts on said mat, said struts each having the shape of a vertical segment of a cylindrical wall, said struts spaced uniformly circumferentially about said aperture; and a plurality of substantially perpendicularly upstanding cylindrical rings spaced circumferentially about a periphery of said mat and having a vertical extent above said mat substantially equal to a vertical extent of said struts above said mat.

53. An irrigation head support for use with an irrigation head having a radially extending flange, comprising:

a substantially rigid perforate substantially circular mat formed by a plurality of radially spaced concentric substantially circular ribs connected by a plurality of circumferentially spaced substantially radially extending ribs;

a substantially circular aperture formed centrally in said mat and dimensioned to receive an irrigation head therethrough; and a plurality of substantially perpendicularly upstanding cylindrical rings spaced circumferentially about a periphery of said mat and having a vertical extent above said mat.

54. The irrigation head support of claim 53, further comprising a pair of substantially concentric support ring members in coaxial relationship in said aperture, each of said support ring members having a plurality of upstanding support struts for supporting a radially extending flange of an irrigation head; and an inner one of said support ring members being selectively removable to allow use of said irrigation head support with two different standard diameter sizes of irrigation heads.

55. A method of supporting an irrigation head having a radially extending flange and at least partially buried in earth, comprising the steps of:

providing a substantially rigid perforate mat having an aperture formed therethrough, at least one upstanding support strut adjacent said aperture, and at least one upstanding tubular member having a vertical extent above said mat substantially equal to a vertical extent of said at least one support strut above said mat;

placing said mat around said irrigation head, with said irrigation head extending at least partially through said aperture; supporting said radially extending flange of said irrigation head on said at least one support strut; and covering said mat with a filler material.

56. The method of claim 55 material wherein said filler material is earth.

57. The method of claim 55 wherein said filler material is sod.

* * * * *